US005221000A

United States Patent [19]

Lee

[11] Patent Number: 5,221,000

[45] Date of Patent: Jun. 22, 1993

[54] SHAVING MUG

[76] Inventor: Norman R. Lee, 680 Periwinkle Way, Huntingtown, Md. 20639

[21] Appl. No.: 848,066

[22] Filed: Mar. 9, 1992

[51] Int. Cl.[5] ..... A47K 5/08

[52] U.S. Cl. ..... 206/77.1; 206/204; 206/205; 206/581; 215/6; 215/12.1; 215/261; 215/308; 132/289; 132/290

[58] Field of Search ..... 215/1 C, 6, 12.1, 261, 215/308; 220/737, 738, 739, 740; 206/204, 205, 77.1, 581; 132/289, 290; 248/682

[56] References Cited

U.S. PATENT DOCUMENTS

| | | | |
|---|---|---|---|
| 345,295 | 7/1886 | Forchheimer | 206/77.1 |
| 453,538 | 6/1891 | Berninghaus | 206/77.1 |
| 511,323 | 12/1893 | Blasi | 132/290 |
| 839,970 | 1/1907 | Taylor | 132/290 |
| 880,207 | 2/1908 | Foster | 206/77.1 |
| 903,089 | 11/1908 | Holzsager | 132/290 X |
| 940,409 | 11/1909 | Toffler | 206/77.1 X |
| 962,091 | 6/1910 | Pagan | 132/289 X |
| 1,164,979 | 12/1915 | Benko | 132/290 X |
| 1,369,767 | 3/1921 | Amis | 206/77.1 |
| 1,815,482 | 7/1931 | Peterson | 132/289 |
| 2,285,996 | 6/1942 | McKelvy | 132/289 |
| 2,678,513 | 5/1954 | Amendola | 132/289 |
| 3,326,401 | 6/1967 | De Long | 215/308 |
| 3,332,540 | 7/1967 | Browning | 132/289 |
| 3,951,293 | 4/1976 | Schulz | 215/261 |
| 4,754,888 | 7/1988 | Letsch et al. | 215/12.1 |
| 4,928,848 | 5/1990 | Ballway | 215/12.1 X |
| 5,040,719 | 8/1991 | Ballway | 215/12.1 X |

FOREIGN PATENT DOCUMENTS

| | | | |
|---|---|---|---|
| 513877 | 11/1930 | Fed. Rep. of Germany | 215/308 |
| 3125350 | 1/1983 | Fed. Rep. of Germany | 206/205 |
| 2037719 | 7/1980 | United Kingdom | 215/308 |

*Primary Examiner*—Allan N. Shoap
*Assistant Examiner*—Stephen Cronin

[57] ABSTRACT

Over thirty years of frustrations associated with the inadequate performance of "coffee mugs" that were adapted for use as "shaving mugs" prompted my development of a true SHAVING MUG designed specifically to hold a typical shaving soap cake in a manner that is convenient to the user. A shaving mug made in accordance with this patent application will:

a. Hold the soap cake secure enough to prevent dislodging during use, cleaning, or even rough handling.
b. Protect the soap cake from contamination.
c. Prevent soap or water residue from leaking out during storage.
d. Permit the soap cake to dry quickly between use.
e. Not break easily.

These attributes represent significant design improvements resulting in a shaving mug designed specifically for brush type shaving lather products and clearly corrects the deficiencies of the existing mugs.

2 Claims, 1 Drawing Sheet

SHAVING MUG

BACKGROUND OF THE INVENTION

My invention relates to shaving mugs. The primary objectives are to eliminate the adverse characteristics of the currently existing mugs and provide a person with a reuseable shaving mug designed specifically to hold a typical shaving soap cake in a manner that is truly convenient to the user, even in travel environments. The adverse characteristics of the currently existing shaving mugs are:

a. The soap cake easily dislodges allowing the soap cake to flop around during use or to fall into the sink during clean-up.
b. A lid is not provided or is not secured, allowing other items in luggage to become soiled when traveling.
c. Breaks easily if dropped during use or luggage handling.

SUMMARY OF THE INVENTION

A shaving mug made in accordance with my invention will:

a. Prevent the soap cake from dislodging during use, . . . cleaning, . . . handling, . . . or storage.
b. Provide a space to contain the lather during use.
c. Permit the soap cake to dry quickly between use.
d. Protect the soap cake from contamination between use, especially during travel.
e. Prevent soap and water from soiling clothing and other items in luggage during travel.
f. Not break when dropped from normal sink heights or during typical rough handling of luggage.

This specification describes the preferred form of my invention; it being understood that, within the scope of what hereinafter is thus claimed, diverse changes in the form, proportions, size, materials, and minor details of the structure may be made without departing from the spirit or sacrificing any of the advantages of the invention.

BRIEF DESCRIPTION OF THE DRAWINGS

Reference is to be made to the accompanying drawings, which form a part of this specification in which similar characters of reference (call-outs) indicate corresponding parts in all the views.

DESCRIPTION OF THE PREFERRED EMBODIMENT

Figure 2:
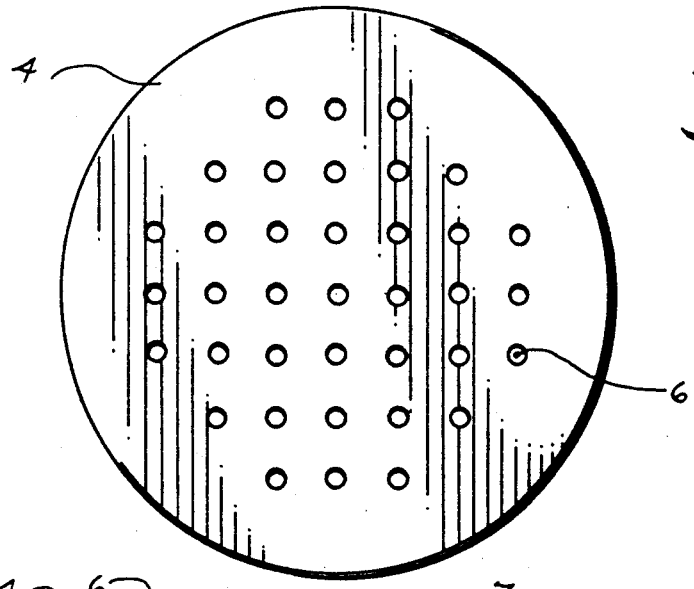
FIG. 2 is a top view of the lid.
Figure 1:
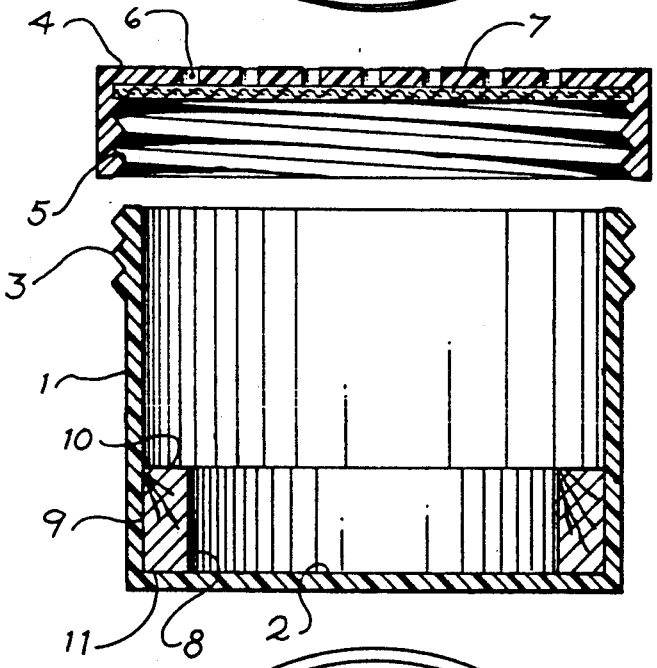
FIG. 1 is a vertical cross-section of my invention with the lid slightly elevated above the open end of the receptacle.
Figure 3:
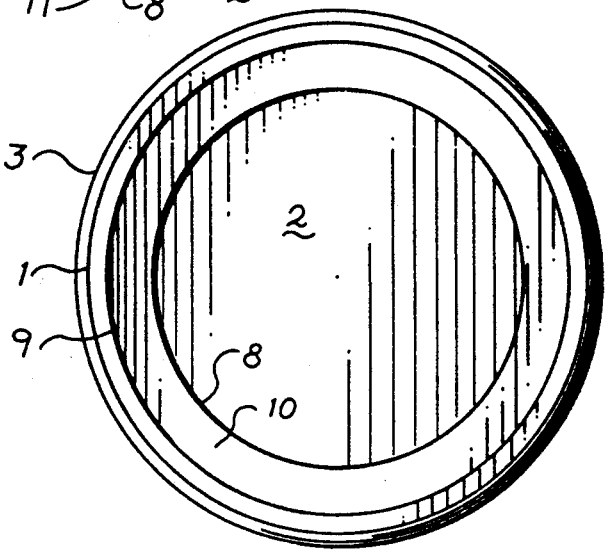
FIG. 3 is a top view of the open receptacle.

As illustrated in FIGS. 1 and 3, the body of the receptacle is a hollow cylinder approximately 3.25 inches in diameter and 2.5 inches deep that has a straight wall (1) and a flat bottom (2). The other end of the cylinder is open with a threaded feature (3) on the outer surface. The receptacle lid (4) is threaded (5) to mate with the body thread (3). The lid top is flat and has multiple perforations (6). The pattern of the perforations (6) (illustrated in FIG. 2) is not critical, but the total open surface area must be sufficient to permit the soap cake to dry within 24 hours. The receptacle body (1, 2, 3) and the lid (4, 5) should be opaque, rigid, noncorrosive, and waterproof (high impact resistant plastic is the preferred material). The given method of lid to body attachment (5, 3) is not mandatory, but the method used should provide a secure seal and facilitate numerous open/close cycles with minimal degradation.

A thin, high moisture absorption filter (7) is secured in contact with the inside surface of the lid top (4). The method used to secure the filter (7) to the lid top (4) is not critical; however, the method used must not impede the drying feature of the lid perforations (6).

The novel feature of my invention is the design of an inner liner that is located in contact with the receptacle bottom and is permanently bonded to the receptacle. The bonding material is not critical, but it should create a secure bond and remain flexible after curing. The liner is an open cylinder approximately 0.75 inches deep, with straight walls (8, 9) approximately 0.3 inches thick and flat on both ends (10, 11), forming a concentric ring that is designed to stow a typical round soap cake. The liner's inside wall (8) diameter is designed to be slightly larger than the soap cake's outside diameter. The most novel feature of my invention is the bond that develops between the soap cake and the liner inside wall (8) after the shaving mug has been used and allowed to dry. Being made from a low moisture absorption material, the liner inside wall (8) will absorb a small amount of the moisture and, during the drying period, form a bond with the outside wall of the soap cake that will be continually strengthened with each use of the shaving mug. This novel feature prevents the soap cake from dislodging. However, the liner inside wall (8) diameter must not create too big a gap (no greater than 0.060 inch) between the soap cake and the liner inside wall (8), because that could prevent a bond from forming. The liner outside wall (9) diameter is designed to fit snugly inside the receptacle wall (1).

The area above the liner top (10) and the rim of the shaving mug provides ample space to work-up a lather to a proper consistency for shaving, and to contain the lather prior to transfer to the user's face. After the user finishes shaving, the unused lather should be rinsed from the shaving mug and any remaining water should be poured out. The shaving mug should be sealed by securing the receptacle lid (4) to the receptacle body (1). Then the exterior surface of the shaving mug should be wiped dry with a towel to remove any moisture residue prior to storage between use.

Having thus described my invention, I claim as new and desire to secure by Letters Patent:

1. A shaving mug comprising an inner liner surrounded by a container, a ventilated lid having a filter, and a secure mechanical attachment feature that will facilitate numerous open/close cycles of said container and lid without degradation;

said inner liner made with a low moisture absorption material formed in the shape of a cylinder open on both ends defining a concentric ring with dimensions to snugly receive and temporarily hold a soap cake with a clearance gap between said ring and said soap cake of less than 0.060 inches so that the normal drying process after use will form a bond between the inner liner and the soap cake;

said container made of a rigid, waterproof, durable, and break resistant material formed in the shape of a cylinder closed with a flat bottom on one end, said cylinder defining a cavity with dimensions to snugly receive and permanently hold said inner liner adjacent said flat bottom, and said cylinder having a threaded feature on the outer surface of the open end of the cylinder for cooperation with said mechanical attachment feature of said lid;

said lid made of the same material and dimensions compatible with said container and formed in the shape of a cylinder closed with a flat top on one end defining a cavity which will receive and permanently hold said filter, said lid having multiple perforations in said top for ventilating said container.

2. The shaving mug of claim 1, wherein said filter made with a high moisture absorption material formed in the shape of a flat thin disk with dimensions and perforations compatible with said lid which forms a liquid barrier while permitting gaseous ventilation.

* * * * *